US008860627B2

(12) United States Patent
Scolamiero et al.

(10) Patent No.: US 8,860,627 B2
(45) Date of Patent: Oct. 14, 2014

(54) RECONFIGURABLE REFLECTOR FOR ELECTROMAGNETIC WAVES

(75) Inventors: Lucio Gerardo Scolamiero, Wassenaar (NL); Marco Sabbadini, Leiden (NL)

(73) Assignee: Agence Spatiale Europeenne, Paris Cedex (FR)

( * ) Notice: Subject to any disclaimer, the term of this patent is extended or adjusted under 35 U.S.C. 154(b) by 1282 days.

(21) Appl. No.: 11/902,586

(22) Filed: Sep. 24, 2007

(65) Prior Publication Data

US 2012/0229355 A1 Sep. 13, 2012

(51) Int. Cl.

| | |
|---|---|
| ***H01Q 15/16*** | (2006.01) |
| ***H01Q 19/10*** | (2006.01) |
| ***H01Q 1/08*** | (2006.01) |
| ***H01Q 15/14*** | (2006.01) |
| ***H01Q 19/19*** | (2006.01) |

(52) U.S. Cl.

CPC ..... *H01Q 15/147* (2013.01); *H01Q 15/168* (2013.01); *H01Q 15/161* (2013.01); *H01Q 1/08* (2013.01); *H01Q 19/192* (2013.01)

USPC ..... 343/880; 343/915; 343/897; 343/761

(58) Field of Classification Search

CPC ..... H01Q 15/147–15/148; H01Q 15/161; H01Q 15/168; H01Q 1/08

USPC ..... 343/915, 908, 897, 878, 880, 914, 725, 343/912

See application file for complete search history.

(56) References Cited

U.S. PATENT DOCUMENTS

| | | | | |
|---|---|---|---|---|
| 4,484,198 | A * | 11/1984 | Georgel | 343/880 |
| 4,750,002 | A * | 6/1988 | Kommineni | 343/915 |
| 4,906,087 | A * | 3/1990 | Ealey et al. | 359/849 |
| 4,940,318 | A * | 7/1990 | Ealey et al. | 359/849 |
| 5,434,697 | A * | 7/1995 | Ameer | 359/224.1 |
| 5,440,320 | A * | 8/1995 | Lach et al. | 343/915 |
| 5,592,336 | A * | 1/1997 | Saito et al. | 359/871 |
| 6,424,090 | B1 * | 7/2002 | Sklyarevich | 315/5 |
| 6,661,384 | B2 * | 12/2003 | Mizuno | 343/703 |

(Continued)

FOREIGN PATENT DOCUMENTS

FR 2 648 278 12/1990

OTHER PUBLICATIONS

K. Pontoppidan, "Light-Weight Reconformable Reflector Antenna Dish", Proc. of the 28th ESA Antenna Workshop on Space Antenna Systems and Technologies, May 2005.

(Continued)

*Primary Examiner* — Robert Karacsony
*Assistant Examiner* — Amal Patel
(74) *Attorney, Agent, or Firm* — Clark & Brody

(57) ABSTRACT

A reconfigurable reflector for electromagnetic waves, comprising: a rigid support element (10) having a front surface (13); an elastically deformable reflective membrane (30) lying over the front surface of said rigid support element; and a plurality of linear actuators (20) for deforming said reflective membrane by operating on predetermined points thereof; wherein said linear actuators are embedded within said rigid support element, and have shafts (22) protruding by the front surface thereof for operating on predetermined points of said elastically deformable reflective membrane.

Figure 1:
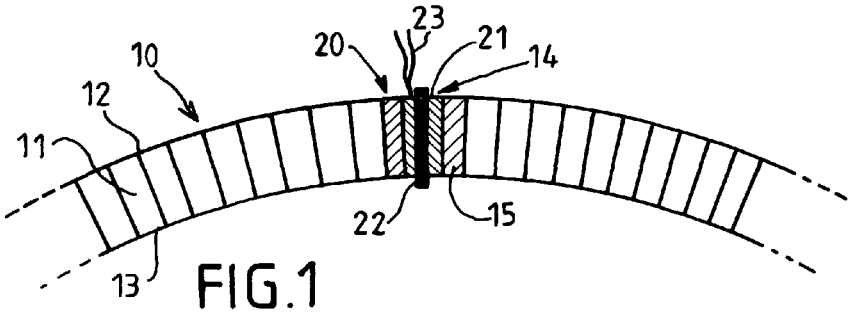

Preferably, the rigid support element comprises a reflector dish having a sandwich structure having a honeycomb core (11) made of CFRP or aluminum, in which the linear actuators are embedded by conventional potting techniques.

Antenna system comprising such a reconfigurable reflector, possibly operating as a subreflector (SR), and spacecraft telecommunication.

22 Claims, 1 Drawing Sheet

(56) References Cited

U.S. PATENT DOCUMENTS

| | | | | |
|---|---|---|---|---|
| 6,828,949 | B2 * | 12/2004 | Harless | 343/915 |
| 6,888,515 | B2 * | 5/2005 | Bekey | 343/912 |
| 7,538,472 | B2 * | 5/2009 | Browne et al. | 310/311 |
| 2004/0113863 | A1 * | 6/2004 | Stonier | 343/897 |

OTHER PUBLICATIONS

H. Baier et al., "Concepts and Technologies for Precision Unfurlable Reflectors", Proceedings of the 15th ESA Antenna Workshop on Satellite Antenna Technology (ESA VPP-202), 2002.

* cited by examiner

RECONFIGURABLE REFLECTOR FOR ELECTROMAGNETIC WAVES

The invention relates to a reconfigurable reflector for electromagnetic waves, and more specifically to a mechanically reconfigurable reflector for a space-borne microwave antenna system.

In the field of space telecommunication, there is a strong demand for in-orbit operational flexibility of antenna system. In particular, it is highly desirable to be able to modify, during operation, the antenna coverage parameters: beam shape, contour and pointing.

Dynamical reconfiguration of an antenna system can be achieved by using a microwave feed array provided with a variable beam-forming network, based on the principle of aperture synthesis. However, beam-forming networks are heavy, complex and costly, and introduce high power losses.

Another known possibility is to use an antenna system comprising a plurality of selectable (sub)reflectors, each corresponding to a different beam shape. A system according to this principle is described by French Patent Application FR2648278. The drawbacks of this solution are obvious: only a finite number of possible beam shapes can be selected, the system is heavy, mechanically complex and insufficiently reliable.

A promising alternative would consist in actively changing the shape of a reflective surface of an antenna reflector or sub-reflector. A number of attempts of realizing a practical reconfigurable antenna system based on this principle have already been made, but none has led to fully satisfactory results.

Other attempts were based on piezoelectric actuated patches bonded or embedded into the reflector structure to achieve an active control of the reflector shape itself, utilizing a "bi-metallic" effect. Those attempts have resulted in insufficient reflector surface displacement fields, critical system complexity and still unresolved technical difficulties (e.g. long term compatibility of piezo-patches with supporting structure, overall thermo-elastic stability, high voltage actuation . . . ).

A different approach to a mechanically reconfigurable reflector consists in using a number of linear actuators, positioned on the back side of the reflector and acting in a push/pull mode to deform the front, reflective surface into the desired shape. This technique is indeed currently used for actively controlled optical telescopes mirrors. However, mirror materials and structures for optical applications are substantially different from the ones typically used for lower frequencies, e.g. microwaves up to the V-band, and so are the mechanical requirements in terms of displacement and actuation bandwidth. This makes difficult to transfer technological solution from one field to the other.

U.S. Pat. No. 5,440,320 discloses a reconfigurable antenna reflector comprising a cylindrical, drum-like support structure having a flat bottom and a cylindrical side wall, and an elastically deformable reflective membrane affixed to said cylindrical side wall and extending above said flat bottom. Up to 100 linear actuators extend from the flat bottom of the support structure to the elastically deformable reflective membrane; said actuators can be operated to deform said membrane by exerting a push-pull action on predetermined points thereof.

A theoretical description of the operation of a reconfigurable antenna reflector of this kind is provided by the paper "Light-weight reconformable reflector antenna dish" by Knud Pontoppidan, (Proc. of the 28$^{th}$ ESA Antenna Workshop on Space Antenna Systems and Technologies, May 2005).

U.S. Pat. No. 5,440,320 is focused on overcoming the so-called "pillow effect", i.e. an excess deformation of the membrane on the actuator attachment points, but it does not address other implementation problems which make the reconfigurable antenna reflector impractical for space applications.

The main drawbacks of the reflector of U.S. Pat. No. 5,440,320 are its mass, its mechanical complexity and its insufficient thermo-elastical stability.

The present invention consists of a new mechanical architecture for a reconfigurable reflector overcoming at least some of the drawbacks of the prior art.

The main idea of the invention consists in integrating, in a very compact and thermo-elastically stable fashion, the deformable reflective membrane and the linear actuators, together with the reflector supporting structure itself.

Another distinguishing feature of the invention is the utilization of a standard, composite sandwich technology based, monolithic reflector dish, as the supporting structure on which the different system components are integrated.

Still another distinguishing feature of the invention is the idea of embedding linear actuators into the reflector structure, utilizing standard structural insert technology.

According to the invention, the deformable membrane duplicates and overlaps the reflector front skin, but remains physically detached from it. Advantageously, the deformable membrane can be realized on the same mould used for the reflector shell curing process.

Other advantageous features of the invention are:

Utilization of a reflective membrane which is suitably pre-shape to the desires undeformed reflector shape.

Utilization of a standard reflector sandwich structure and its internal volume, both for accommodating and supporting the mechanical actuators and to provide conformal support to the reflective membrane.

Utilization of miniaturized linear actuators embedded into the reflector sandwich structure, by means of conventional technologies already in use for sandwich insert potting applications.

All the above points cooperate in the achievement of major advantages with respect to the present state of the art.

The main advantages of this new architecture consist in its technical feasibility and economical effectiveness, which are achieved by means of:

Maximum utilization of standard technologies and materials.

Minor impact on standard reflector manufacturing process: only standard technology is required.

The number of control points (and therefore of actuators) is minimized because essentially determined by beam shape re-configuration needs starting from the as-manufactured shape.

Minimum impact in terms of reflector envelope and accommodation requirements: the actuators are embedded within the body of the reflector, thus leaving the overall occupied volume and thickness almost unchanged.

Minimum impact on the mechanical properties of the reflector, and in particular on its stiffness.

High thermo-elastic stability, since the main structural element is realized with standard high stability technology, and the actuators/membrane interfaces are internal and shielded by the sandwich structure itself. Conventional thermal protection technologies can be used for a (sub) reflector being produced according to this invention.

It is possible to define and implement classes of solutions (product lines) suitable for different frequency band and reconfiguration needs based on the same architecture with different types of membranes and actuators.

An object of the present invention is thus a reconfigurable reflector for electromagnetic waves, comprising: a rigid support element having a front surface; an elastically deformable reflective membrane lying over the front surface of said rigid support element; and a plurality of linear actuators for deforming said reflective membrane by operating on predetermined points thereof; wherein said linear actuators are embedded within said rigid support element, and have shafts protruding by the front surface thereof for operating on predetermined points of said elastically deformable reflective membrane.

According to particular embodiments of the invention:

Said elastically deformable reflective membrane, in an undeformed state thereof, can contact the front surface of said rigid support element and matches its shape.

Said front surface of said rigid support element can have a three-dimensional shape chosen among: a planar shape, a cylindrical shape, a spherical shape, a paraboloidal shape, a hyperboloidal shape, an ellipsoidal shape.

Said elastically deformable reflective membrane can have a diameter comprised between 200 mm and 2 m.

Said elastically deformable reflective membrane can be affixed to said rigid support element.

Said rigid support element can comprise a reflector dish having a sandwich structure, in particular having a honeycomb or foam core. The sandwich structure of said reflector dish can be essentially constituted of a material chosen between a fiber-reinforced plastic material, a light metal such as aluminum and a light alloy, and have a thickness comprised between 15 mm and 30 mm.

Said linear actuators can be piezoelectric actuators.

The reconfigurable reflector of the invention can comprise at least ten and preferably between ten and one hundred of said linear actuators.

The shafts of said linear actuators can extend perpendicularly from the front surface of the rigid support element.

The shafts of said linear actuators can be axially movable, with a stroke of at least 20 mm, between a retracted position, in which said shafts are flush with the front surface of the rigid support element or behind it, and a protruded position, in which said shafts protrude from said front surface.

The shafts of said linear actuators can be axially movable with an accuracy of better than 50 μm.

Said elastically deformable reflective membrane can be adapted for reflecting microwaves up to the V-band.

Said elastically deformable reflective membrane can comprise a membrane made of a fiber-reinforced plastic material, unidirectional multilayer, woven fabric, open wave tri-axial fabric, or a membrane made of a metallic mesh.

The reconfigurable reflector of the invention can further comprise closed-loop control means for controlling the operation of said linear actuator in order to obtain a predetermined deformed shape of said elastically deformable reflective membrane.

Another object of the invention is an antenna system having a reconfigurable beam pattern, comprising a device for emitting and/or receiving electromagnetic waves and at least a reconfigurable reflector as described above, said reconfigurable reflector cooperating with said device for determining said reconfigurable beam pattern of the antenna system. In particular, said reconfigurable reflector can be a subreflector, and the antenna system can further comprise a non-reconfigurable main reflector cooperating with said subreflector for determining said reconfigurable beam pattern of the antenna system.

Still another object of the invention is a spacecraft telecommunication payload comprising such an antenna system.

Figure 2A:
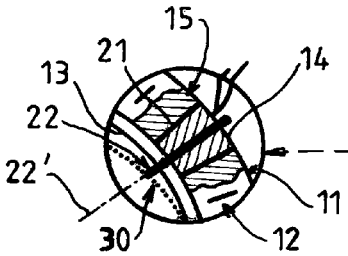
Figure 2:
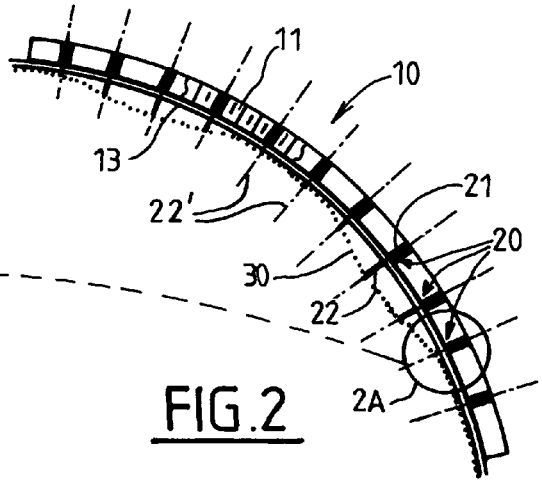

Additional features and advantages of the present invention will become apparent from the subsequent description, taken in conjunction with the accompanying drawings, which show:

FIG. 1, a view in section of the rigid support element with a linear actuator embedded in it;

FIG. 2, schematically, a view in section of the reconfigurable reflector of the invention, comprising a rigid support element and an elastically deformable reflective membrane;

FIG. 2A, a detail of FIG. 2; and

Figure 3:
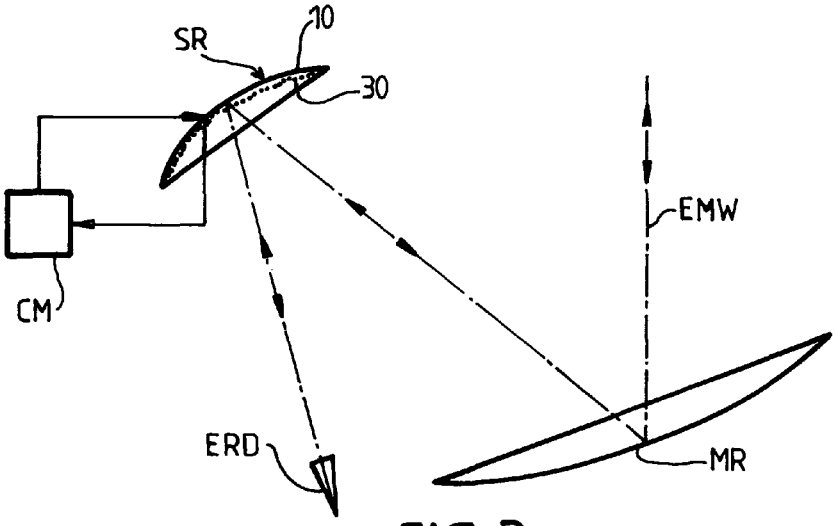

FIG. 3, schematically, a reconfigurable antenna system according to an embodiment of the invention.

The rigid support element 10 of the reconfigurable reflector of the invention is a standard reflector dish having e.g. a parabolic shape, having a sandwich structure comprising a honeycomb core 11 disposed between a back 12 and a front 13 skin. The honeycomb core 11 can be made of CFRP (carbon-fiber reinforced plastic), which is the preferred embodiment, or of a light metal or alloy, such as aluminum, or of low thermal expansion foam. Its thickness can be comprised between 15 and 30 mm, and will typically be of the order of 20 mm. The support element can typically have a diameter (or maximal lateral dimension) comprised between 20 cm and 2 m.

A number of holes or cavities 14 are opened in the body of the support, element 10 for accommodating the linear actuators 20. The number and position of said cavities depend on the shape-change requirements of the reflectors, as described by the above-cited paper by Knud Pontoppidan; the number of actuators can be typically comprised between ten and one hundred. The cavities or holes are obtained by drilling the sandwich of support element 10 where resin potting 15 is locally applied. According to a preferred embodiment of the invention, holes 14 are essentially cylindrical, in order to allow mounting of the actuators 20 form either sides. According to an alternative embodiment (non-represented on the figures), holes can be larger on the front surface and be limited to the need for routing the actuator harness 23 (and possibly, for allowing retraction of the actuator shaft) on the back surface.

A linear actuator 20, preferably of the piezoelectric kind, is located inside each cavity 14, its body 21 being directly glued to the cavity walls or mechanically fastened to a structural "through-hole" metallic insert, placed in the cavity. The latter type of actuator mounting (with insert) would be preferable because it allows for easy removal of the actuator.

Actuators 20 have a linearly translating shaft 22 whose axis 22' is substantially perpendicular to the front surface 13 of the support element 10. As represented on FIG. 1, the shafts 22 can extend from both sides of the corresponding actuator body 22, but this is by no means essential.

Shafts 22 are axially movable between a retracted position, in which said shafts are flush with the front surface 13 or behind it, and a protruded position, in which they protrude from said front surface.

The actuators 20 have the following typical requirements:

max output force approx 10.0 N max stroke approx 20 mm actuator main body length about 20 mm (or less)

external diameter about 10 mm (or less)

A plurality of mini linear actuators exist commercially, from conventional electrical motors with lead/ball screw coupling for linear motion transformation, to direct drive linear motors based on piezo effect: "inch-worms" (EXFO Burleigh Products Group Inc.), "inertial" (Klocke Nanotechnik), "squiggle" (New Scale Technologies Inc.) type, and many other under development.

Although use of conventional electrical motors plus screw-type linear drives can be envisaged, piezo-based actuators are strongly preferred. Major advantages of piezoelectric actuators are: simplicity, miniaturization, variety of new concepts based on unlimited stroke possibilities (limited only by the output shaft length), direct drive and no-power holding capability.

The reflective membrane 30 can be realized in thin CFRP technology by utilizing (e.g.) open wave tri-axial fabrics, which have been proved suitable for RF applications up to Ka-band, are ultra stable (coefficient of thermal expansion below 1.0 part per million and highly isotropic) and still have low membrane stiffness due to the geometrical features of the weaving.

Diameter sizes in the range 200-300 mm, up to 1.0-2.0 m can be envisaged as feasible with the presented architecture. Typically, for a sub-reflector application, the diameter can be between 300 mm and 600 mm.

Also combination of alternative materials, with better deformability properties, can be utilized, e.g. aramid fabrics with radio-frequency reflective element embedded or etched or bonded onto the surface as commonly utilized for "dual gridded" antenna applications or "dichroic" sub-reflector applications. Another possibility is to use highly deformable silicon-based CFRP membranes under ESA development ("Concepts and Technologies for Precision Unfurlable Reflectors", Baier, H. et al., Proceedings of The 25$^{th}$ ESA Antenna Workshop on Satellite Antenna Technology (ESA VPP-202), 2002).

For lower frequency band applications (up to Ku-band), metallic grid/metallic mesh combinations could also be used, but still with caution concerning thermo-elastic stability aspects (metal has very high coefficient of, thermal expansion) and inter-modulation-products (critical when metal-metal sliding contacts are present for certain applications).

The rest shape of the reflecting membrane and therefore the shape of the supporting sandwich are to be determined following an analysis of the re-configuration envelope on the basis of the radio-frequency requirements. The resulting shape is in all respect similar to that of classical shaped-reflector antenna. Therefore it does not pose any additional implementation constraints.

The connection between the reflective membrane and the actuator output shaft would be realized by means of bonding, mechanical fastening, or with alternative techniques, also depending on the output shaft material and termination.

The connection between the reflective membrane and the sandwich would be realized by means of cleats at outer edge leaving adequate rotational flexibility (especially in case re-shaping of outer edges areas).

Different means of connecting the reflective membrane to the sandwich supporting structure can be envisaged, based on the application details. It is also possible to connect the membrane only to the actuator shafts, and not to the support element.

FIGS. 2 and 2A show how the axial displacement of the actuator shafts 22 can deform the reflecting membrane 30, thus allowing reconfiguration of the reflector. These figures are not drawn to scale, the membrane deformation being exaggerated by a factor of about ten.

A distinct advantage of the invention with respect to the prior art is that the rest shape of the reflective membrane 30 already matches that of a "basic" reflector, typically having a cylindrical, spherical paraboloidal, hyperboloidal, ellipsoidal shape or any other smooth and regular one; actuators 20 are only required to superimpose a comparative small deformation field to said basic reflector shape. On the contrary, in the case of U.S. Pat. No. 5,440,320, the actuators fully determine the shape of the reflecting membrane, and therefore they need a much larger stroke or additional spacers.

FIG. 3 represents an antenna system having a reconfigurable beam pattern, based on the principle of the invention. The antenna system comprises a device ERD for emitting and/or receiving electromagnetic waves EMW (more particularly, microwaves up to the V-band), a secondary reflector SR and a larger main reflector MR arranged according to the principle of a Gregorian telescope. Sub-reflector SR is a reconfigurable element as described above, the shape of the reflective membrane 30 being controlled in closed-loop by suitable control means CM.

An important element of the system is its calibration and the implementation of a suitable actuator position control loop to achieve the prescribed membrane shape. The re-configurable sub-reflector would need to be fully characterized, on ground, in terms of correlation between the actuator displacements field, membrane surface physical shape, and overall antenna pattern.

Finite element analysis, accurate surface metrology, electrical analysis and synthesis tools and radio frequency measurements would be instrumental in this phase to calibrate the system and ensure its robustness.

Once the correlation between desired antenna pattern and actuator displacement fields is established on ground, means CM for controlling the actuator positions in orbit need to be implemented. The accuracy to be reached on the actuators displacements is in the order of 20 μm to 50 μm. Basically three approaches can be envisaged:

a) To implement in the linear actuators a position sensor (based on inductive or most likely optical technology), and force the membrane to reach a prescribed shape by commanding each actuator to a prescribe position. By following this approach, of course, a number of undesired membrane distortions, due to e.g. thermal, ageing, gravity effects, would not be compensated.

b) To implement an in-orbit reflector surface measurement capability, and tuning the actuators positions until the membrane surface shape has reached its prescribed contour.

Recent advances in the field of miniaturized cameras and CCD sensor technology increase the interest for this approach.

c) The third possibility would be to tune the actuator positions by direct radio frequency measurements to the generated RF pattern. This can be achieved by using the same mathematical techniques used to synthesize the desired reflector shape from the required antenna beam characteristics as part of the normal antenna design.

The antenna system of FIG. 3 is particularly suitable for being applied to a spacecraft telecommunication payload. Indeed, conventional reflector MR can have a large diameter, as required for space applications, while reconfiguration capability is provided by the smaller sub-reflector. Optionally, sub-reflector SR can even have a planar shape, focusing being entirely provided by main reflector MR.

However, different architectures are also possible: main reflector MR or both the main and secondary reflectors can be reconfigurable. A device according to the invention can also be used in a single-reflector configuration.

The invention claimed is:

1. A reconfigurable reflector for radio-frequency waves, comprising:

a rigid support element having a front surface, the front surface being rigid;

an elastically deformable reflective membrane adapted for reflecting radio-frequency waves and microwaves and lying on the rigid front surface of said rigid support element; and a plurality of linear actuators for deforming said reflective membrane by operating on predetermined points thereof;

wherein said linear actuators are embedded within said rigid support element, and have shafts protruding from the rigid front surface thereof for operating on predetermined points of said elastically deformable reflective membrane with strokes ranging from 0 mm to 20 mm;

said deformable reflective membrane has a sufficient thickness to accommodate strokes from linear actuators up to 20 mm, wherein said rigid front surface is not deformed when said reflective membrane is deformed by said linear actuators, and further wherein said elastically deformable reflective membrane, in an undeformed state thereof, contacts the rigid front surface of said rigid support element and matches its shape.

2. The reconfigurable reflector for radio-frequency waves according to claim 1, wherein said rigid front surface of said rigid support element has a shape chosen among: a planar shape, a cylindrical shape, a spherical shape, a paraboloidal shape, a hyperboloidal shape, an ellipsoidal shape.

3. The reconfigurable reflector for radio-frequency waves according to claim 1, wherein said elastically deformable reflective membrane has a diameter comprised between 200 mm and 2 m.

4. The reconfigurable reflector for radio-frequency waves according to claim 1, wherein said elastically deformable reflective membrane is affixed to said rigid support element.

5. The reconfigurable reflector for radio-frequency waves according to claim 1, wherein said rigid support element comprises a reflector dish having a sandwich structure.

6. The reconfigurable reflector for radio-frequency waves according to claim 1, wherein said linear actuators are piezoelectric actuators.

7. The reconfigurable reflector for radio-frequency waves according to claim 1, comprising at least ten and preferably between ten and one hundred of said linear actuators.

8. The reconfigurable reflector for radio-frequency waves according to claim 1, wherein the shafts of said linear actuators extend perpendicularly from the rigid front surface of the rigid support element.

9. The reconfigurable reflector for radio-frequency waves according to claim 1, wherein the shafts of said linear actuators are axially movable, with a stroke of at least 20 mm, between a retracted position, in which said shafts are flush with the rigid front surface of the rigid support element or behind it, and a protruded position, in which said shafts protrude from said rigid front surface.

10. The reconfigurable reflector for radio-frequency waves according to claim 1, wherein the shafts of said linear actuators are axially movable with an accuracy of better than 50 μm.

11. The reconfigurable reflector for radio-frequency waves according to claim 1, wherein said elastically deformable reflective membrane is adapted for reflecting microwaves up to the V-band.

12. The reconfigurable reflector for radio-frequency waves according to claim 1, further comprising closed-loop control means for controlling the operation of said linear actuator in order to obtain a predetermined deformed shape of said elastically deformable reflective membrane.

13. A microwave antenna system having a reconfigurable beam pattern, comprising a device for emitting and/or receiving microwaves waves and at least a reconfigurable microwave reflector according to claim 1, said reconfigurable reflector cooperating with said device for determining said reconfigurable beam pattern of the antenna system.

14. The reconfigurable reflector for radio-frequency waves according to claim 1, configured for being applied to a spacecraft payload.

15. The reconfigurable reflector for radio-frequency waves according to claim 1, wherein the elastically deformable reflective membrane is realized by utilizing either open wave triaxial fabrics in thin carbon fiber reinforced polymer technology, or aramid fabrics with radio-frequency reflective element embedded or etched or bonded, or silicon-based carbon fiber reinforced polymer, or metallic grid or metallic mesh combinations.

16. The reconfigurable reflector for radio-frequency waves according to claim 5, wherein the sandwich structure of said reflector dish has a honeycomb or foam core.

17. The reconfigurable reflector for radio-frequency waves according to claim 16, wherein the sandwich structure of said reflector dish is essentially constituted of a material chosen between a fiber-reinforced plastic material, a light metal such as aluminum and a light alloy.

18. The reconfigurable reflector for radio-frequency waves according to claim 17, wherein the sandwich structure of said reflector dish has a thickness comprised between 15 mm and 30 mm.

19. The reconfigurable reflector for radio-frequency waves according to claim 11, wherein said elastically deformable reflective membrane comprises a membrane made of a fiber-reinforced plastic material, open wave tri-axial fabric.

20. The reconfigurable reflector for radio-frequency waves according to claim 11, wherein said elastically deformable reflective membrane comprises a membrane made of a metallic mesh.

21. The microwave antenna system according to claim 13, wherein said reconfigurable microwave reflector is a subreflector, and further comprising a non-reconfigurable main reflector cooperating with said subreflector for determining said reconfigurable beam pattern of the antenna system.

22. A spacecraft telecommunication payload comprising a microwave antenna system according to claim 13.

* * * * *